US010293472B2

(12) United States Patent
Padget et al.

(10) Patent No.: US 10,293,472 B2
(45) Date of Patent: May 21, 2019

(54) SPEED LIMITING GOVERNOR OF A ROTATING SHAFT IN AIR

(71) Applicants: Robert Bosch Tool Corporation, Broadview, IL (US); Robert Bosch GmbH, Stuttgart (DE)

(72) Inventors: Bradley D. Padget, Huntley, IL (US); Daniel Blythe, Arlington Heights, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 828 days.

(21) Appl. No.: 14/714,280

(22) Filed: May 16, 2015

(65) Prior Publication Data

US 2015/0328762 A1 Nov. 19, 2015

Related U.S. Application Data

(60) Provisional application No. 61/994,178, filed on May 16, 2014.

(51) Int. Cl.

| | |
|---|---|
| ***B25F 5/00*** | (2006.01) |
| ***B24B 23/02*** | (2006.01) |
| ***B24B 23/00*** | (2006.01) |
| *B24B 55/10* | (2006.01) |
| *B24B 49/08* | (2006.01) |
| *B24B 47/14* | (2006.01) |

(52) U.S. Cl.

CPC ..... *B25F 5/00* (2013.01); *B24B 23/00* (2013.01); *B24B 23/026* (2013.01); *B25F 5/001* (2013.01); *B24B 47/14* (2013.01); *B24B 49/08* (2013.01); *B24B 55/10* (2013.01); *B24B 55/102* (2013.01)

(58) Field of Classification Search

CPC .... B25F 5/00; B25F 5/001; B25F 3/00; B24B 23/026; B24B 47/14; B24B 55/10; B24B 23/00; B24B 49/08; B24B 55/102

See application file for complete search history.

(56) References Cited

U.S. PATENT DOCUMENTS

| | | | | | |
|---|---|---|---|---|---|
| 2,375,490 | A | * | 5/1945 | Overly | B24B 23/026 137/547 |
| 2,428,726 | A | * | 10/1947 | Sturrock | F01C 20/00 418/43 |
| 2,975,517 | A | * | 3/1961 | Brittain | B26B 19/34 30/133 |
| 3,138,870 | A | * | 6/1964 | Stachon | B26B 19/34 30/133 |
| 3,312,105 | A | * | 4/1967 | Amtsberg | G01L 25/003 73/862.13 |

(Continued)

*Primary Examiner* — Alexander M Valvis
*Assistant Examiner* — Mobeen Ahmed
(74) *Attorney, Agent, or Firm* — Maginot Moore & Beck LLP

(57) ABSTRACT

A power tool includes a housing, an output shaft, and a tool holder connected to the output shaft. A rotor assembly is attached to the output shaft that is configured to be acted on by a fluid flow through the housing to cause rotation of the output shaft. A centrifugally movable fluid flow governor is coupled to the output shaft that is configured to move outwardly from the output shaft to alter a force acting on the rotor assembly when the output shaft reaches a predetermined speed.

17 Claims, 4 Drawing Sheets

(56) References Cited

U.S. PATENT DOCUMENTS 3,385,377 A * 5/1968 Amtsberg ..... B25B 23/145 173/178
3,697,189 A * 10/1972 Tibbott ..... B23B 45/02 137/53
3,740,174 A * 6/1973 Amtsberg ..... G05D 13/00 137/56
3,749,530 A * 7/1973 Amador ..... F01C 20/08 137/50
3,923,429 A * 12/1975 Schaedler ..... F01B 25/06 137/57
3,932,055 A * 1/1976 Flatland ..... B23B 45/042 415/131
4,057,113 A * 11/1977 Paule ..... B23B 45/04 137/53
4,281,457 A * 8/1981 Walton, II ..... A61F 15/02 30/124
4,298,317 A * 11/1981 Hansson ..... F01C 20/00 137/50
4,592,430 A * 6/1986 Hall ..... B25B 23/145 173/178
4,729,436 A * 3/1988 Amador ..... B23Q 5/06 173/179
5,340,233 A * 8/1994 Motl ..... E02D 3/02 104/14
5,383,771 A * 1/1995 Ghode ..... F01C 13/02 415/904
6,347,985 B1 * 2/2002 Loveless ..... B24B 55/10 451/354
7,040,972 B2 * 5/2006 Hoffmann ..... B24B 23/00 451/344
8,528,659 B2 * 9/2013 Nelson ..... B24B 23/026 173/218
2002/0197123 A1 * 12/2002 Kopras ..... B25F 5/02 409/182
2005/0200087 A1 * 9/2005 Vasudeva ..... B25F 3/00 279/143
2005/0221739 A1 * 10/2005 Hoffmann ..... B24B 23/00 451/357
2006/0251485 A1 * 11/2006 Hirschburger ..... B23C 1/20 409/137
2008/0028568 A1 * 2/2008 Tiede ..... B24B 23/00 15/329
2008/0142091 A1 * 6/2008 Meinig ..... F16K 7/17 137/488
2008/0146125 A1 * 6/2008 Loveless ..... B24B 23/026 451/357
2009/0017737 A1 * 1/2009 Hesse ..... B24B 23/04 451/354
2009/0017738 A1 * 1/2009 Fuchs ..... B24B 23/00 451/354
2009/0104860 A1 * 4/2009 Stierle ..... B24B 23/02 451/344
2011/0297412 A1 * 12/2011 Suzuki ..... B24B 23/026 173/218
2014/0030081 A1 * 1/2014 Bullock ..... F01C 20/24 415/203
2014/0034346 A1 * 2/2014 Eklund ..... F01D 15/062 173/179

* cited by examiner

SPEED LIMITING GOVERNOR OF A ROTATING SHAFT IN AIR

CROSS-REFERENCE TO RELATED APPLICATIONS

This application claims priority to U.S. Provisional Application Ser. No. 61/994,178 entitled "SPEED LIMITING GOVERNOR OF A ROTATING SHAFT IN AIR" by Padget et al., filed May 16, 2014, the disclosure of which is hereby incorporated herein by reference in its entirety.

TECHNICAL FIELD

The disclosure relates generally to power tools, and more particularly to pneumatically-powered tools which utilize a flow or air to rotate an output shaft.

BACKGROUND

In general, rotary power tools are light-weight, handheld power tools capable of being equipped with a variety of accessory tools and attachments, such as cutting blades, sanding discs, grinding tools, and many others. These types of tools typically include a generally cylindrically-shaped main body that supports a drive mechanism and often serves as a hand grip for the tool as well. The drive mechanism includes an output shaft that is equipped with an accessory attachment mechanism, such as a collet, that enables various accessory tools to be releasably secured to the power tool.

Accessory tools for rotary power tools typically have a work portion and a shank. The work portion is configured to perform a certain kind of job, such as cutting, grinding, sanding, polishing, and the like. The shank extends from the work portion and is received by an accessory attachment system on the power tool. The accessory attachment mechanism holds the shank in line with the axis of the output shaft so that, when the output shaft is rotated by the motor, the accessory tool is driven to rotate about the axis along with the output shaft.

The output shaft is rotated at very high speeds when driving an accessory tool to perform work. The accessory tools and accessory attachment mechanisms for rotary tools are designed for operation up to a pre-specified maximum limit without losing integrity or falling apart. As an example, accessory tools for a rotary tool may have a rated limit of 35,000 rpm above which the accessory tools should not be operated.

Some rotary tools, however, are capable of rotational speeds that exceed the rated limit of the accessory tools with which they are configured to operate. In these cases, speed limiting mechanisms and systems are incorporated into the drive system of the tool to ensure that the rated limit of the accessory tools is not exceeded. For electrically powered tools, the rotational speed of the electric motor may be easily controlled and limited in a variety of ways through the design of the circuitry. For pneumatically powered tools, however, speed limit control must be implemented in other ways. Therefore, one issue faced in the design of pneumatically-powered rotary tools is coming up with effective and efficient means for limiting the speed of the rotary tool without hampering or adversely impacting performance.

DRAWINGS

DETAILED DESCRIPTION

Figure 1:
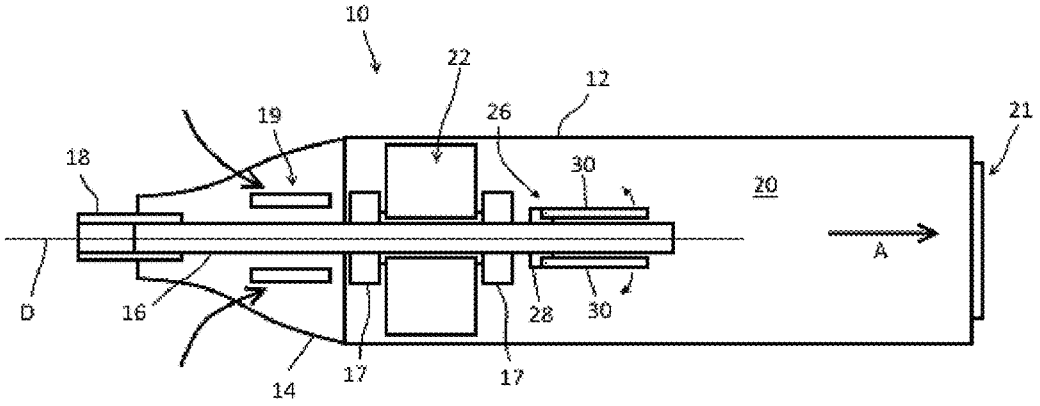
FIG. 1 is a schematic cross-sectional view of a pneumatically-powered rotary tool including a centrifugal governor in accordance with a first embodiment of the disclosure.

For the purposes of promoting an understanding of the principles of the invention, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one of ordinary skill in the art to which this disclosure pertains.

The disclosure is directed to the incorporation of a centrifugal governor into a pneumatically-powered tool, such as a pneumatic rotary tool or similar type of tool, which utilizes a flow of fluid such as air, oxygen, or the like to rotate an output shaft of the tool. The centrifugal governor is incorporated directly onto the output shaft of the tool so that the rotational movement of the drive shaft provides the centrifugal force for the governor. As a result, the centrifugal governor is located directly in the path of air flow which drives the output shaft. The centrifugal governor is configured to utilize the centrifugal force provided by the rotating output shaft to directly regulate the rotational speed of the output shaft. When the centrifugal force reaches a certain level, a speed control mechanism of the governor is deployed which is configured to reduce the rotational speed of the output shaft in some manner.

As discussed below, the speed control mechanism implemented by a centrifugal governor may be configured to regulate the speed of the output shaft in a variety of different ways. For example, the speed control mechanism may be configured to act directly on the flow of air of the drive system, e.g., by restricting air flow, to reduce the speed of the output shaft. Speed control mechanisms may also be configured to act as a braking mechanism on the output shaft by expanding and contacting other components to generate friction. Speed control mechanisms may be configured to regulate speed by opening a vent to create a bypass which diverts air flow away from the drive system. Speed control mechanisms may also be configured to deploy and use the flow of air to generate torque in opposition to the drive system.

In accordance with one embodiment of the disclosure, a power tool comprises a housing defining a fluid flow passage and including a fluid flow inlet and a fluid flow outlet. At least one of the fluid flow inlet and the fluid flow outlet is configured to be connected to a fluid flow source, such as a vacuum or a source of compressed air, configured to cause a fluid flow through the fluid flow passage from the fluid flow inlet to the fluid flow outlet. An output shaft is rotatably supported in the housing for rotation about a drive axis, and a tool holder is connected to the output shaft for rotation therewith about the drive axis. The tool holder is located externally with respect to the housing and is configured to releasably retain a tool, such as an accessory tool for a rotary power tool. A rotor assembly is attached to the output shaft and is located in the fluid flow passage between the fluid flow inlet and the fluid flow outlet. The rotor assembly is configured to be acted on by the fluid flow through the fluid flow passage such that the rotor assembly and the output shaft are rotated about the drive axis by the fluid flow.

A speed control mechanism in the form of a centrifugally movable fluid flow governor is coupled to the output shaft and is configured to be rotated by the output shaft about the drive axis. The fluid flow governor is located in the fluid flow passage between the fluid flow inlet and the fluid flow outlet and includes at least one movable structure configured to move outwardly with respect to the output shaft in dependence on a magnitude of a centrifugal force acting on the at least one movable structure. The centrifugal force depends in part on a rotation speed of the output shaft. The at least one movable structure is configured to alter a force acting on the rotor assembly in response to the output shaft reaching a predetermined speed. The predetermined speed may be any desired speed and may depend on the ratings of one or more of the components of the tool. In one embodiment, the predetermined speed is 10,000-50,000 rpm. In one particular embodiment, the predetermined speed is based on the speed rating of accessory tools, e.g., not to exceed 35,000 rpm.

The movable structure(s) of the fluid flow governor may be configured to alter the force acting on the rotor assembly in a number of ways. In one embodiment, when the at least one movable structure moves outwardly from the output shaft, the at least one movable structure is configured to alter the force acting on the rotor assembly by restricting the fluid flow in the fluid flow passage acting on the rotor assembly. In another embodiment, when the at least one movable structure moves outwardly from the output shaft, the at least one movable structure is configured to alter the force acting on the rotor assembly by contacting a non-moving surface within the housing to increase a friction force acting on the rotor assembly via the output shaft.

In yet another embodiment, the movable structure may configured to alter the force acting on the rotor assembly by opening a bypass vent in the housing to reduce the fluid flow acting on the rotor assembly. The movable structure may also be configured to alter the force acting on the rotor assembly by generating a torsional force on the output shaft in the opposite direction from the direction of rotation of the output shaft. The torsional force in the opposite direction may be generated by fan blades that are oriented in the appropriate direction with respect to the fluid flow in the housing.

The fluid flow governor can be provided in a variety configurations. For example, the fluid flow governor may comprise at least one lever arm pivotably coupled to the output shaft. The lever arm may be biased toward the output shaft by a biasing member that applies a biasing force to the lever arm. In this embodiment, the at least one lever arm is configured to be pivoted outwardly from the output shaft when the centrifugal force acting on the at least one lever arm is capable of overcoming the biasing force. To enable this, the biasing force of the biasing member is selected based in part on the predetermined speed so that the biasing force is overcome by the centrifugal force that results from the output shaft reaching the predetermined speed. The lever arm may be configured to alter the force acting on the rotor assembly in one or more of the ways mentioned above, e.g., by restricting air flow, contacting a non-moving surface to generate friction, carrying a fan blade that is configured to generate a reverse torsional force, or opening a bypass vent.

The fluid flow governor may be provided on the rotor assembly itself. In one embodiment, the fluid flow governor comprises at least one flap structure attached to an outer circumferential portion of the rotor assembly. The flap structure(s) may be integral with the rotor assembly and attached to the rotor assembly by weakened points that are configured to allow the flaps to move, e.g., by pivoting, bending, or flaring, outwardly with respect to the rotor assembly and into contact with the non-moving surface when the output shaft reaches the predetermined speed. In another embodiment, the fluid flow governor may be provided as a split ring wrapped around an outer circumferential portion of the rotor assembly. The split ring being may be configured to expand outwardly from the rotor assembly and into contact with the non-moving surface when the output shaft reaches the predetermined speed.

Referring now to FIG. 1, an embodiment of a pneumatic power tool 10 having a centrifugal governor is depicted. The tool 10 includes a generally cylindrically shaped housing 12 having a nose portion 14. The housing components may be constructed of a durable material, such as plastic, metal, or composite materials such as a fiber reinforced polymer.

A pneumatic drive system is enclosed within the housing. The drive system includes an output shaft 16 that is rotatably supported within the housing in bearings 17 for rotation about a drive axis D. The output shaft 16 extends through the nose portion 14 of the housing. A tool holder 18, such as a collet, is provided on the end of the output shaft 16 and is accessible at the nose portion 14 of the housing. The accessory attachment mechanism 18 is configured to receive the shank of an accessory tool (not shown) and to clamp onto the shank in order to secure the accessory tool to the output shaft.

The drive system is configured to utilize a fluid flow, e.g., air, gas, oxygen, to rotate the output shaft 16. The housing 12 defines at least one fluid inlet 19, at least one fluid outlet 21, and a fluid flow passage or channel 20 that fluidly connects the inlet 19 and the outlet 21. At least one of the inlet and outlet is configured to be connected to a fluid flow source that is configured to generate a fluid flow in he channel 20.

In the embodiment f FIG. 1, the tool 10 is configured to utilize a fluid flow source that comprises a vacuum. The fluid outlet 21 is configured to be connected to the vacuum such that a fluid flow is generated in the channel 20 of the housing 12 in the direction A from the inlet(s) 19 to the outlet 21. In alternative embodiments, the tool may be configured to use a fluid flow source that comprises compressed air in which case the positions of the fluid inlet(s) 19 and fluid outlet(s) 21 would be reversed and the direction of flow would be opposite the direction A in FIG. 1.

The power tool includes a rotor assembly 22 mounted onto the output shaft 16 that is configured to use the fluid flowing through the channel 20 to rotate the output shaft 16.

In the embodiment of FIG. 1, the rotor assembly 22 comprises at least one fan, e.g., a turbine fan, mounted onto the output shaft 16 in a rotationally fixed manner. The rotor assembly 22 is positioned in channel 20 of the housing between the fluid inlet(s) 19 and the fluid outlet(s) 21 to be acted on by the fluid flow in the channel. The rotor assembly 22 has blades that are oriented to impart rotation to the output shaft 16 in a desired direction about the drive axis D.

In accordance with the disclosure, the power tool 10 includes a centrifugal governor 26 that is configured to influence the rotation speed of the rotor assembly 22/output shaft 16. The governor 26 is used to limit the rotation speed of the output shaft 16 from exceeding a predetermined level. For example, in the presence of an air flow generated by a standard vacuum cleaner, a rotor assembly with one or more turbine fans can cause the output shaft 16 to rotate at speeds up to 60,000 rpm. This speed may exceed the speed rating for certain components and accessories that are used in/on the tool. For example, many accessory tools for use with rotary power tools have a speed rating of 35,000 rpm (not to exceed). The centrifugal governor 26 may be configured to limit the rotation speed of the output shaft 16 to a speed that is within or does not exceed this speed rating. However, in practice, the governor 26 may be configured to impose substantially any desired speed limit on the tool.

The centrifugal governors described herein include at least one movable structure that is configured to be moved outwardly with respect to the output shaft by the centrifugal force acting on the at least one movable structure due to rotation of the output shaft 16. The movement of the at least one movable structure is used to alter a force acting on the rotor assembly 22 in a manner that limits the rotation speed of the output shaft, e.g., by restricting air flow in the channel 20, by increasing friction/resistance working against the rotation of the output shaft 16, by opening a bypass valve to reduce the air flowing through the rotor assembly, and the like. As is known in the art, the centrifugal force acting on the movable structure(s) depends in part on the rotation speed of the output shaft. Taking this into consideration, the movement of the at least one movable structure can be configured to move in a predetermined manner at a predetermined rotation speed in order to produce the desired result.

In the embodiment of FIG. 1, the centrifugal governor 26 comprises one or more lever arms 30 that are pivotably mounted onto the output shaft 16. The lever arms 30 are pivotably mounted onto a collar 28 that is attached to the output shaft 16. In alternative embodiments, the lever arms may be mounted onto the output shaft 16 in any suitable manner. Each lever arm 30 extends from the collar 28 in the direction of air flow A. The lever arms 30 are pivotable between a closed position (FIG. 1) and a deployed position (FIG. 2) in relation to the output shaft 16. In the closed position, the lever arms 30 are folded down toward the output shaft 16 so as to provide minimal obstruction to the air flow in the air channel 20.

Figure 2:
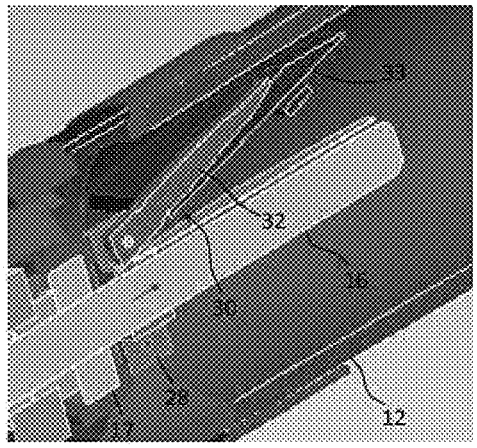
FIG. 2 depicts a fragmentary, cross-sectional view of the rotary tool of FIG. 1 showing the centrifugal governor in greater detail.

In the deployed position, the lever arms 30 are pivoted outwardly from the output shaft 16. Referring to FIG. 2, a biasing mechanism 32 may be used to apply a biasing force to the lever arms 30 that biases the arms 30 toward the closed position. The biasing mechanism 32 may comprise a flat spring, a magnet, a helical spring, or the like and may be configured to act between the lever arms and the output shaft, between the lever arms and the housing wall, or in the joint where the lever arms and are connected to the collar 28.

The biasing force counters the centrifugal force acting on the lever arms 30 during rotational movement of the output shaft 16. The biasing force is configured to retain the lever arms 30 in the closed position until the rotational speed of the output shaft 16 reaches a certain level at which the centrifugal force on the arm overcomes the biasing force and the lever arm pivots away from the output shaft 16 toward the deployed position as depicted in FIG. 2. The biasing force may be configured to enable movement of the lever arm(s) with respect to the output shaft that is proportional to the rotation speed of the output shaft. In this case, the movable structure(s) of the governor may be configured to alter the force acting on the rotor assembly/output shaft in a proportional manner, e.g., through a proportional restriction of air flow, braking power, torsional resistance, bypass valve opening, and the like.

In the embodiment of FIGS. 1 and 2, the lever arms 30 are configured to alter the force acting on the rotor assembly by restricting air flow in the channel 20. To this end, the lever arms 30 may include widened foil structures 33 as depicted in FIG. 2. which increase the surface area for blocking air flow in the channel 20. However, the lever arms 30 may have any suitable configuration for restricting or obstructing air flow in the channel.

Figure 3:
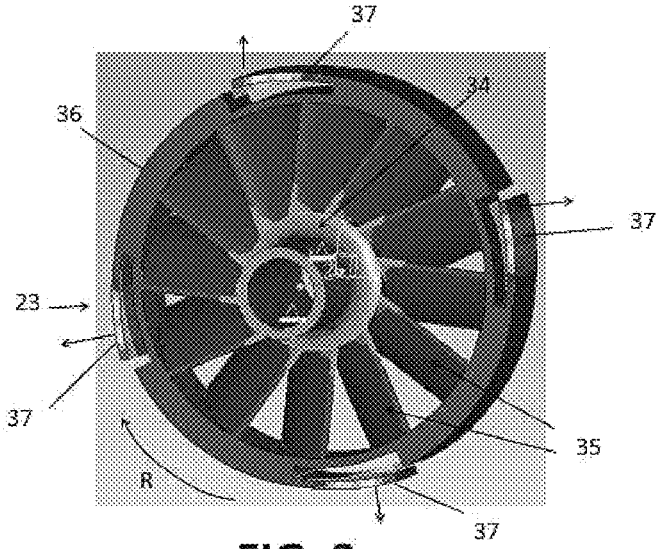
FIG. 3 is a schematic view of a second embodiment of a centrifugal governor for use with a pneumatically-powered rotary tool which is incorporated into the output shaft of the rotary tool in the form of flaps provided on a fan of the rotor assembly.

FIGS. 3-6 depict embodiments of governors that are configured to generate a frictional force that resists the rotation of the rotor assembly and/or output shaft 16. In FIG. 3, the movable structures are provided on the outer periphery of a fan 23 of the rotor assembly 22. The fan 23 includes a hub 34 through which the output shaft 16 (not shown in FIG. 3) extends. A plurality of fan blades 35 extend outwardly from the hub 34 to an outer perimeter wall 36 that extends circumferentially around the outer ends of the blades 35. The movable structures in FIG. 3 comprise flaps 37 that are provided on the outer perimeter wall 36. The flaps 37 are attached at one end to the wall 36 and are cantilevered in a direction that is opposite the direction of rotation R of the fan. The free ends of the flaps 37 are configured to move, e.g., by pivoting, bending, or flaring, outwardly with respect to the outer perimeter wall 36 of the fan depending on the rotation speed of the output shaft 16. When the flaps 37 flare outwardly, they are configured to come into contact with a non-moving surface in the housing 12. As the fan rotates, the flaps 37 will rub against the non-moving surface thereby generating friction that acts against the rotation of the output shaft.

Flap structures, such as depicted in FIG. 3, may be configured to flare outwardly at predetermined speeds in any suitable manner. In FIG. 3, the flaps 37 are integral with the outer perimeter wall 36 of the fan and are formed by removing material from the outer perimeter wall 36. The dimensions, such as the thickness of the flap and/or connection region of the flap, as well as the materials can be selected to produce the desired amount of bending or flaring at desired rotation speeds. In alternative embodiments, flap structures may be separate components that are added onto the outer perimeter wall, and the manner in which the flaps are connected to the wall may be configured to enable the desired bending/flaring performance. In addition, flap structures may be provided on structures other than the fan that are mounted onto the output shaft.

Figure 4:
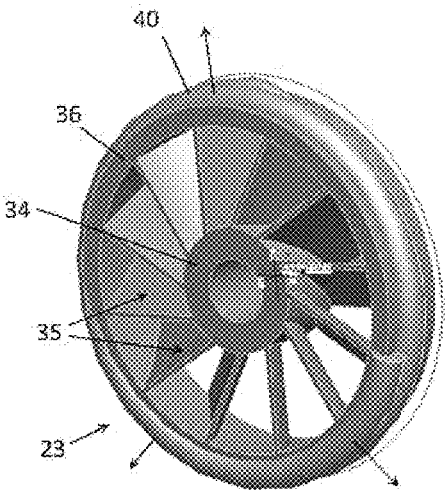
FIG. 4 depicts a third embodiment of a centrifugal governor for use with a pneumatically-powered rotary tool which includes a split ring mounted onto a turbine fan of the rotary tool.
Figure 5:
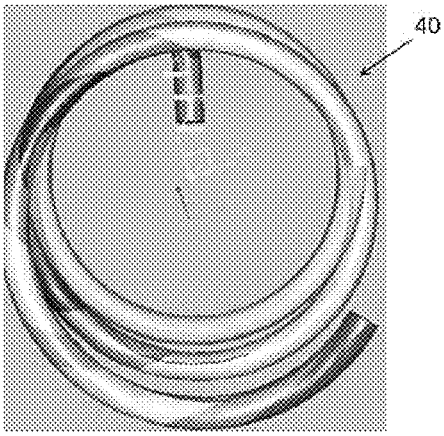
FIG. 5 depicts the split ring of FIG. 4 in isolation.

FIGS. 4 and 5 depict an embodiment of a movable structure for a governor that comprises a separate structure provided on the outer perimeter 36 of a fan 23 of the rotor assembly. In FIGS. 4 and 5, the movable structure comprises a split ring 40 that is wrapped around the outer wall 36 of the fan. Because the spit ring 40 comprises a coil of metal wire, the split ring has a built in biasing force that serves to maintain the split ring tightly wrapped on the outer wall of the fan. The split ring 40 is configured to expand when the centrifugal force acting on the split ring is sufficient to overcome the biasing force. When the split ring 40 expands, the expanded ring is configured to come into contact with a non-moving surface in the housing 12. As the fan rotates, the expanded spring will rub against the non-moving surface thereby generating friction that acts against the rotation of the output shaft. The split ring 40 may be configured to expand at predetermined rotation speeds by selecting the appropriate material(s) and/or dimensions for the ring to produce the desired amount of expansion at desired rotation speeds.

Figure 6:
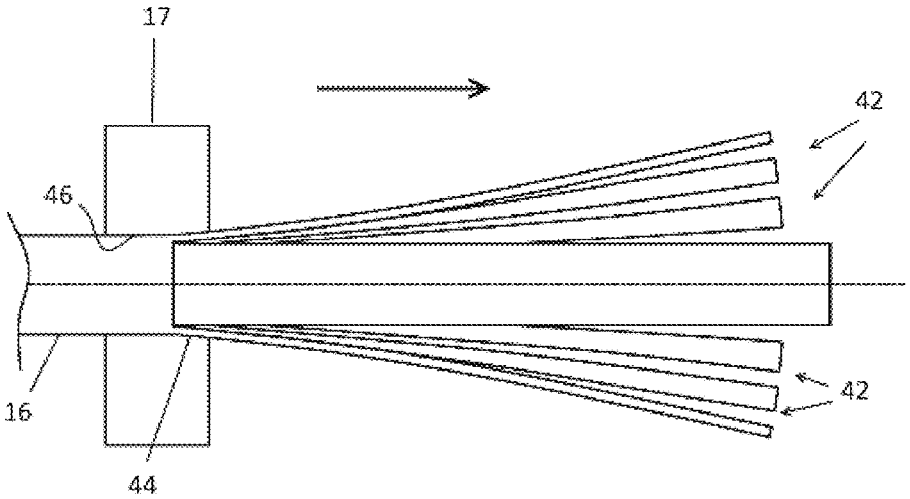
FIG. 6 depicts a fourth embodiment of a centrifugal governor for use with a pneumatically-powered rotary tool in the form of fingers configured to create interference on an inner race of a bearing for the output shaft.

FIG. 6 depicts an embodiment of a governor having movable structures that are configured to generate friction by acting on at least one bearing 17 for the output shaft 17. In FIG. 6, the movable structures comprise fingers 42 that are arranged around the circumference of the output shaft 16. Each finger 42 has a base 44 that is attached to the output shaft 16 and a body that extends along the output shaft 16 in the direction of air flow A. As can be seen in FIG. 6, the base 44 of each finger 42 is located within the inner race 46 of the bearing 17 for the output shaft 16. The fingers 42 are arranged substantially parallel to the output shaft 16 at rest and are configured to bend or spread outwardly from the output shaft when the centrifugal force due to the rotation speed of the output shaft reaches a predetermined level. As the fingers 42 spread outwardly, the base 44 of the fingers applies pressure against the inner bearing race 46 resulting in an increase in friction and resistance to rotation. In the embodiment of FIG. 6, the fingers 42 are integral with the output shaft 16 although in alternative embodiments the fingers may be separate components added to the output shaft 16. As with the other embodiments, the dimensions as well as the dimensions of the fingers can be selected to produce the desired amount of bending or spreading at desired rotation speeds.

Figure 7:
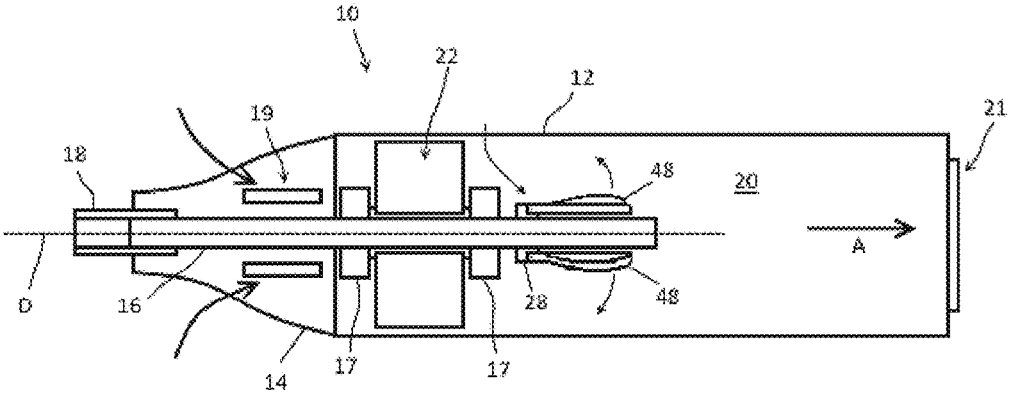
FIG. 7 depicts a sixth embodiment of a centrifugal governor in the form of fan blades arranged to oppose the turbine fan of the rotary tool.

FIG. 7 depicts an embodiment of a movable structure for a governor that comprises fan blades 48 that are oriented in the opposite direction of the fan blades of the rotor assembly 22 in order to generate a torsional force in the opposite direction from the rotation direction of the rotor assembly. The fan blades 48 of FIG. 7 may have a similar configuration as the lever arms of FIG. 1. For example, the fan blades 48 may be pivotably mounted onto a collar 28 that is attached to the output shaft 16. A biasing mechanism (not labeled) may be used to apply a biasing force to the fan blades biases the blades toward the closed position. The biasing mechanism may comprise a flat spring, a magnet, a helical spring, or the like.

Figure 8:
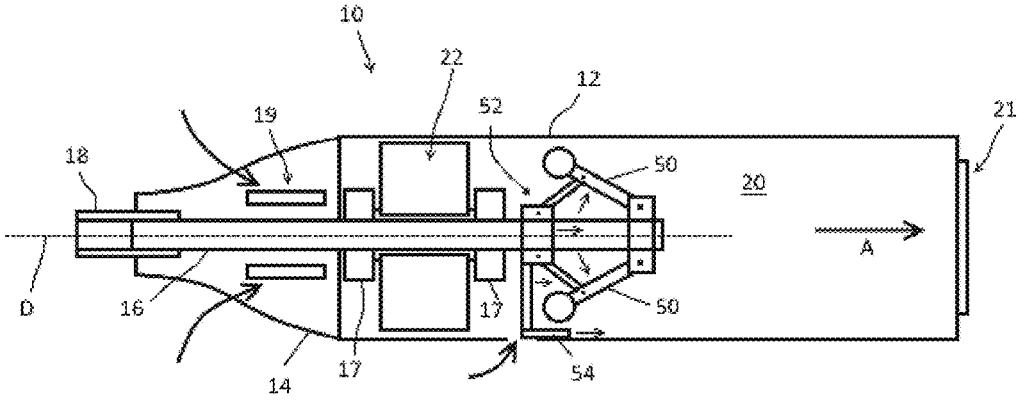
FIG. 8 depicts a fifth embodiment of a centrifugal governor which is configured to open a bypass channel.

FIG. 8 depicts an embodiment of a centrifugal governor in the form of a traditional flyball type governor. The flyball governor includes weighted lever arms 50 which are configured spread centrifugally. The arms 50 are attached to a sliding collar 52 located on the output shaft 16. As the arms 50 spread, the collar 52 is pulled upwardly along the output shaft 16. The sliding collar 52 is linked to a bypass vent or door 54 in the housing 12 that is opened when the sliding collar 52 is moved by the arms 50. The vent or door 54 opens to provide at least one inlet to the air flow channel 20 between the rotor assembly 22 and the air outlet 21 which allows the air flow to at least partially bypass the rotor assembly. A bypass channel may be provided internally or externally with respect to the housing.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A power tool comprising:

a housing defining a fluid flow passage and including a fluid flow inlet and a fluid flow outlet, at least one of the fluid flow inlet and the fluid flow outlet being configured to be connected to a fluid flow source, the fluid flow source being configured to cause a fluid flow through the fluid flow passage from the fluid flow inlet to the fluid flow outlet;

an output shaft rotatably supported in the housing for rotation about a drive axis;

a tool holder connected to the output shaft and rotatable therewith about the drive axis, the tool holder being located externally with respect to the housing;

a rotor assembly attached to the output shaft and located in the fluid flow passage between the fluid flow inlet and the fluid flow outlet, the rotor assembly being configured to be acted on by the fluid flow through the fluid flow passage such that the rotor assembly and the output shaft are rotated about the drive axis by the fluid flow; and a centrifugally movable fluid flow governor coupled to the output shaft between the rotor assembly and the fluid flow outlet and configured to be rotated by the output shaft about the drive axis, the centrifugally movable fluid flow governor being located in the fluid flow passage between the fluid flow inlet and the fluid flow outlet and including at least one movable structure configured to move outwardly with respect to the output shaft in dependence on a magnitude of a centrifugal force acting on the at least one movable structure, the centrifugal force depending in part on a rotation speed of the output shaft, wherein the at least one movable structure is configured to alter a force acting on the rotor assembly in response to the output shaft reaching a predetermined speed, and wherein the fluid flow outlet is configured to be connected to a vacuum source, the vacuum source being the fluid flow source.

2. The power tool of claim 1, wherein the at least one movable structure is configured to alter the force acting on the rotor assembly in response to the output shaft reaching the predetermined speed such that the rotation speed of the rotor assembly and output shaft are limited to the predetermined speed.

3. The power tool of claim 1, wherein, when the at least one movable structure moves outwardly from the output shaft, the at least one movable structure is configured to alter the force acting on the rotor assembly by restricting the fluid flow in the fluid flow passage acting on the rotor assembly.

4. The power tool of claim 3, wherein the at least one movable structure comprises at least one lever arm pivotably coupled to the output shaft, the at least one lever arm being biased toward the output shaft by a biasing member that applies a biasing force to the at least one lever arm, wherein the at least one lever arm is configured to be pivoted outwardly from the output shaft when the centrifugal force acting on the at least one lever arm is capable of overcoming the biasing force, and wherein the biasing force of the biasing member is selected based in part on the predetermined speed so that the biasing force is overcome by the centrifugal force that results from the output shaft reaching the predetermined speed.

5. The power tool of claim 1, wherein, when the at least one movable structure moves outwardly from the output shaft, the at least one movable structure is configured to alter the force acting on the rotor assembly by contacting a non-moving surface within the housing to increase a friction force acting on the rotor assembly via the output shaft.

6. The power tool of claim 5, wherein the at least one movable structure comprises at least one flap structure attached to an outer circumferential portion of the rotor assembly, and wherein the at least one flap structure is configured to be pivoted outwardly from the rotor assembly and into contact with the non-moving surface when the output shaft reaches the predetermined speed.

7. The power tool of claim 5, wherein the at least one movable structure comprises a split ring wrapped around an outer circumferential portion of the rotor assembly, the split ring being configured to expand outwardly from the rotor assembly and into contact with the non-moving surface when the output shaft reaches the predetermined speed.

8. The power tool of claim 1, wherein the housing includes a vent structure arranged on the housing between the rotor assembly and the fluid flow source, the vent structure being configured to be opened to form a fluid bypass that reduces the fluid flow acting on the rotor assembly, and wherein the at least one movable structure is configured to open the vent structure to form the bypass when the output shaft reaches the predetermined speed.

9. The power tool of claim 1, wherein the at least one movable structure comprises at least one fan blade pivotably mounted on the output shaft, the at least one fan blade being configured to be pivoted outwardly from the output shaft when the output shaft reaches the predetermined speed, and wherein the at least one fan blade is oriented so that a torsional force is applied to the output shaft in a direction that is opposite a direction of rotation of the output shaft.

10. The power tool of claim 1, wherein the rotor assembly comprises a turbine fan.

11. The power tool of claim 1, wherein the tool holder is configured to releasably retain an accessory tool.

12. The power tool of claim 1, wherein the predetermined speed comprises 10,000-50,000 rpm.

13. The power tool of claim 12, wherein the predetermined speed comprises 35,000 rpm.

14. A power tool comprising:

a housing defining a fluid flow passage and including a fluid flow inlet and a fluid flow outlet, at least one of the fluid flow inlet and the fluid flow outlet being configured to be connected to a fluid flow source, the fluid flow source being configured to cause a fluid flow through the fluid flow passage from the fluid flow inlet to the fluid flow outlet;

an output shaft rotatably supported in the housing for rotation about a drive axis;

a tool holder connected to the output shaft and rotatable therewith about the drive axis, the tool holder being located externally with respect to the housing;

a rotor assembly attached to the output shaft and located in the fluid flow passage between the fluid flow inlet and the fluid flow outlet, the rotor assembly being configured to be acted on by the fluid flow through the fluid flow passage such that the rotor assembly and the output shaft are rotated about the drive axis by the fluid flow; and a centrifugally movable fluid flow governor coupled to the output shaft between the rotor assembly and the fluid flow outlet and configured to be rotated by the output shaft about the drive axis, the centrifugally movable fluid flow governor being located in the fluid flow passage between the fluid flow inlet and the fluid flow outlet and including at least one movable structure configured to move outwardly with respect to the output shaft in dependence on a magnitude of a centrifugal force acting on the at least one movable structure, the centrifugal force depending in part on a rotation speed of the output shaft, wherein the at least one movable structure is configured to restrict the fluid flow acting on the rotor assembly in response to the output shaft reaching a predetermined speed, wherein the housing includes a nose portion at a first end of the housing and a rear portion at a second end of the housing, the output shaft extending through the nose portion, wherein the fluid flow outlet is defined in the rear portion of the housing and the fluid flow inlet is defined in the nose portion of the cylindrical housing, and wherein the rear portion of the housing is configured to be connected to a vacuum cleaner as the fluid flow source.

15. The power tool of claim 1, wherein the housing is cylindrical about the drive axis.

16. The power tool of claim 15, wherein the housing includes a nose portion at a first end of the housing and a rear portion at a second end of the housing, the output shaft extending through the nose portion, and wherein the fluid flow outlet is defined in the rear portion of the housing and the fluid flow inlet is defined in the nose portion of the cylindrical housing.

17. The power tool of claim 16, wherein the vacuum source is a vacuum cleaner.

* * * * *